US007160598B2

(12) United States Patent
Sabo

(10) Patent No.: US 7,160,598 B2
(45) Date of Patent: Jan. 9, 2007

(54) INTERTOE TOWEL

(76) Inventor: James H. Sabo, 3286 Greenacre Dr., Santa Maria, CA (US) 93455

( * ) Notice: Subject to any disclaimer, the term of this patent is extended or adjusted under 35 U.S.C. 154(b) by 175 days.

(21) Appl. No.: 10/710,354

(22) Filed: Jul. 2, 2004

(65) Prior Publication Data

US 2006/0003140 A1 Jan. 5, 2006

Related U.S. Application Data

(60) Provisional application No. 60/524,395, filed on Nov. 24, 2003.

(51) Int. Cl.
*B32B 1/08* (2006.01)
*B29D 23/00* (2006.01)

(52) U.S. Cl. ..... 428/88; 428/36.1; 428/36.3

(58) Field of Classification Search ..... 428/36.1, 428/36.3, 88
See application file for complete search history.

(56) References Cited

U.S. PATENT DOCUMENTS 6,340,026 B1 * 1/2002 Shapiro ..... 132/73

* cited by examiner

*Primary Examiner*—Jenna-Leigh Befumo
(74) *Attorney, Agent, or Firm*—Laura Tunnell

(57) ABSTRACT

This invention discloses an intertoe towel operable for drying between the toes. The intertoe towel consists of an elongated, tubular body member made of plush absorbent fabric, an elongate flexible core disposed within the tubular member and a loop handle affixed to at least one end of the body member to facilitate pulling the towel between the toes.

1 Claim, 1 Drawing Sheet

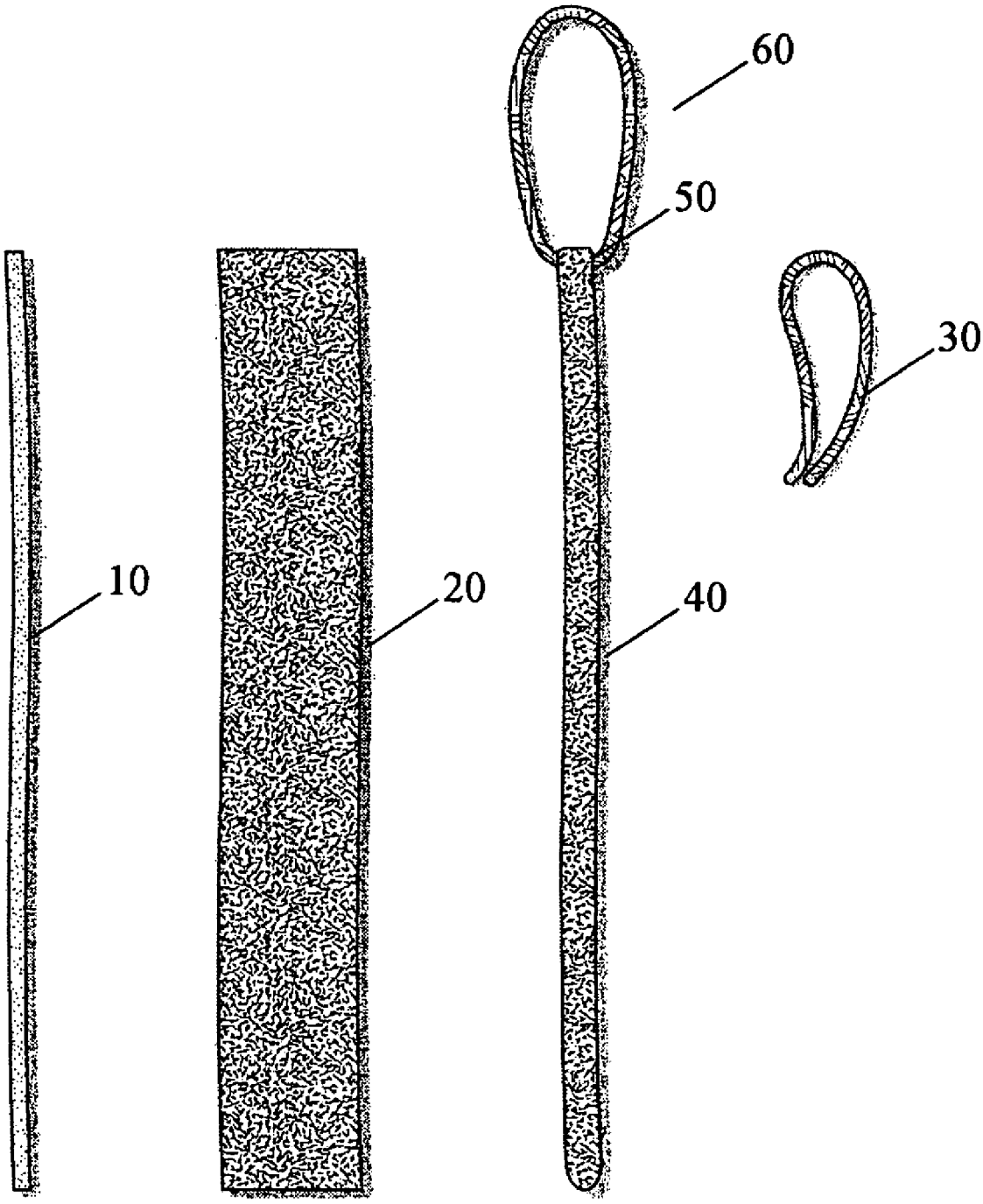
60
50
30
10
20
40

INTERTOE TOWEL

This application claims the benefit of U.S. Provisional Application No. 60/524,395 filed Nov. 24, 2003.

BACKGROUND OF THE INVENTION

The present invention relates to a device to aid in the practice of good foot hygiene, and more particularly, to an elongate, substantially tubular towel operable for drying the skin between the toes.

The human foot is a complex system containing within its relatively small size 26 bones, 33 joints, and a network of more than 100 tendons, muscles, ligaments, blood vessels and nerves. The components of the foot work together, sharing the tremendous pressures of daily living. An average day of walking, for example, brings a force equal to several hundred tons to bear on the feet. The overall comfort of a person depends to a significant degree on the comfort of the person's feet.

A variety of fungal species (i.e., *dermatophytes*) are known to infect the foot, including *Trichophyton rubrum, Trichophyton tonsurans, Epidermophyton floccosum* and *Trichophyton mentagrophytes.* Once these microorganisms establish themselves on the foot, eradication with current over-the-counter antifungal agents is necessary and recurrences of the disease can be expected.

The most common fungal infection of the foot is "athlete's foot", a skin disease, usually starting between the toes or on the bottom of the feet, which can spread to other parts of the body. Athlete's foot is usually caused by colonization of the foot by one or more of the above-referenced dermatophytes fostered in a warm, moist environment, such as exists between the toes. Prevention includes careful foot care practices and proper hygiene. A daily foot washing with soap and warm water and careful drying, especially between the toes is essential.

As important as this practice is, it is often difficult to realize because the feet and toes are situated furthest from the hands, making them difficult to reach. The problem becomes amplified when the individual has a reduced range of motion due to such factors as age and/or arthritis. Accordingly, there is a need for a device to aid in the practice of good foot hygiene, especially with regards to drying between the toes.

SUMMARY

The present invention is directed to a tubular towel and a method for using the towel that substantially obviates one or more of the limitations of the related art for drying between the toes after a bath, shower or swimming activities and the like. To achieve these and other advantages and in accordance with the purpose of the invention, as embodied and broadly described herein, the invention includes a substantially tubular member comprising an absorbent material having a loop at one or both ends. The elongate tubular member must be of a plush absorbent material, preferably terry cloth, with a diameter that enables snug passage of the device between the toes. The tubular member can optionally have an elongate, relatively dense, flexible core disposed within the tubular member and coextensive with the length of the tubular member. In the most preferred embodiment, the fabric core is fixably attached to both ends of the tubular member and the loop.

The features of the invention believed to be novel are set forth with particularity in the appended claims. However the invention itself, both as to organization and method of operation, together with further objects and advantages thereof may be best understood by reference to the following description taken in conjunction with the accompanying drawings.

BRIEF DESCRIPTION OF THE DRAWINGS

FIG. 1 is a schematic view of the components of an intertoe towel in accordance with a preferred embodiment of the present invention wherein the inner core of the towel body is indicated at 10, the outer covering of the towel body at 20, and the handle of the towel at 30. The outer covering 20 is configured in a tubular fashion 40 to accommodate and fully enclose the inner core 10. In the most preferred embodiment, the handle 30 is attached to the body such that its point of attachment 50 securely affixes the handle to both the inner core 10 and the outer covering 20. The fully assembled product is indicated at 60.

DESCRIPTION OF THE PREFERRED EMBODIMENTS

The objective of the present invention is to provide an intertoe towel that may be used for drying between the toes. This objective is met by the provision of a towel comprising an elongate tubular member having an absorbent outer surface and, preferably, a loop at one or both ends. The body of the towel 40 as shown in FIG. 1, consists of a strong, flexible inner core 10 placed inside a tubular member having an outer covering of plush absorbent material 20 such as terry cloth. The surface of the outer covering should be sufficiently large and absorbent to remove all droplets of moisture left between the toes after a bath or shower.

The core 10 is preferably a tightly woven, dense material such as braided rope to provide the body 40 with structural integrity in order to withstand the stress induced by repeatedly pulling the towel between the toes. Since the intertoe towel 40 is intended to be laundered in a washing machine, if a plastic core is employed, the plastic should be selected to withstand the heat of a drier.

The relative length of the body 40 to the handle 30 is largely a matter of preference and comfort. The loop of the handle should be large enough to accomodate at least one finger therein while pulling the towel through the space between the toes. In some cases, it may be preferable that the loop be still longer or that a loop be situated at both ends in order to more easily facilitate usage by a person with a limited range of motion. The size of the loop may be adjustable in order to accommodate the finger(s) or even the entire hand of a disabled person. Further, the loop can facilitate storage of the intertoe towel on a convenient protrusion, such as a hook or doorknob.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claim is:

1. A towel operable for drying between the toes of a person comprising a core made from a braided rope or plastic material, having a diameter, two ends and a length therebetween, said diameter being dimensioned to allow snug passage between the toes, said core having a loop attached to at least one of said two ends, said loop being dimensioned to fit over a doorknob, wherein said length of said core is enveloped by a tubular member, said tubular member being comprised of a plush absorbent material, and wherein said plush absorbent material is fixably attached to each of said two ends of said core and to said loop.

* * * * *